US006398662B1

(12) United States Patent
Cox

(10) Patent No.: US 6,398,662 B1
(45) **Date of Patent: *Jun. 4, 2002**

(54) MOVING PRACTICE GREEN AND BALL PICKUP APPARATUS

(76) Inventor: Alvin Emison Cox, 10612 Hambletonian Pl., Santa Ana, CA (US) 92705

( * ) Notice: Subject to any disclaimer, the term of this patent is extended or adjusted under 35 U.S.C. 154(b) by 0 days.

This patent is subject to a terminal disclaimer.

(21) Appl. No.: 09/346,128

(22) Filed: Jul. 9, 1999

Related U.S. Application Data

(63) Continuation-in-part of application No. 09/042,311, filed on Mar. 13, 1998, now Pat. No. 5,980,392.

(51) Int. Cl.[7] ..... A63B 69/36

(52) U.S. Cl. ..... 473/192; 473/167; 473/409; 414/40

(58) Field of Search ..... 473/166, 168–170, 473/173, 190–192, 195, 196, 197, 409, 150, 151; 134/115; 414/440; 56/328

(56) References Cited

U.S. PATENT DOCUMENTS

| | | | | |
|---|---|---|---|---|
| 3,231,280 A | | 1/1966 | Collins | |
| 3,520,727 A | * | 7/1970 | Crump | 134/115 |
| 4,045,023 A | | 8/1977 | Heffley, Jr. | |
| 4,202,547 A | | 5/1980 | Mueller | |
| 4,593,519 A | * | 6/1986 | Kimball | 56/328 |
| 4,945,923 A | | 8/1990 | Evans et al. | |
| 5,163,677 A | | 11/1992 | Foley | |
| 5,219,161 A | | 6/1993 | William, Sr. | |
| 5,234,215 A | | 8/1993 | Uehara | |
| 5,580,320 A | | 12/1996 | Meikle | |
| 5,603,664 A | * | 2/1997 | Provost | 473/168 |
| 5,738,593 A | * | 4/1998 | Coury et al. | 473/166 |
| 5,974,348 A | * | 10/1999 | Rocks | 701/28 |
| 5,980,392 A | * | 11/1999 | Cox | 473/192 |

FOREIGN PATENT DOCUMENTS

JP 8-107953 * 4/1996

* cited by examiner

*Primary Examiner*—Mark S. Graham
(74) *Attorney, Agent, or Firm*—John J. Connors; Connors & Associates

(57) ABSTRACT

A simulated golf green for practicing variably positioned long distance approach shots on a golf driving practice range; in the form of a mobile golf practice green, ball pickup and return apparatus, having a golf ball impact mat and sensor with a display therefor, having a stray ball gathering and collecting pickup, and having a stationary golf ball return conveyor for reuse of said balls at a golfer's tee. Mobility for positioning the green and for ball collection and for ball return being manual by remote control or by computer programming for routing and positioning the golf practice green, and maneuverability embodied either in a steerable ground supported wheeled vehicle, or in a movable and positionable floating vehicle supported on a water pond golf range trap.

16 Claims, 7 Drawing Sheets

MOVING PRACTICE GREEN AND BALL PICKUP APPARATUS

This is a Continuation In Part of application Ser. No. 09/042,311 filed Mar. 13, 1998 now U.S. Pat. No. 5,980,392 entitled MOVING PRACTICE GREEN AND BALL PICKUP APPARATUS.

BACKGROUND OF THE INVENTION

This invention relates generally to golf ball practice ranges and devices for the facilitation thereof, and more particularly to a motorized practice green moved to selected locations on the range or in a water pond trap for practice of approach shots and further to such an apparatus that performs the duty of collecting and returning the .used golf balls.

DESCRIPTION OF RELATED ART

The following patents define the present state of the art.

Uehara, U.S. Pat. No. 5,234,215 discloses a golf practice range that provides a guide way and a putting green on a field. The green is movable intermittently along the guide way, and at each tee there is a distance indicator which displays the distance from the tee to the green every time the green stops at a predetermined point on the guide way.

Mueller, U.S. Pat. No. 4,202,547 discloses a golf green that is movable along a predetermined track and the golf green being rotatable to provide a multitude of golf green simulated layouts and changing pin positions.

Foley, U.S. Pat. No. 5,163,677 discloses a driving range for driving golf balls from any one of a series of tee points grouped together to a single common golf-driving fairway having a plurality of spaced apart greens, each with a flagged hole. One of the greens is surrounded by man-made pond of water, with a plurality of greens being separated from the driving tee-points by a stream of water, and sand traps with assorted trees, shrubs and/or simulations thereof positioned hetrogeneously. At least two sand traps are positioned adjacent each of the spaced apart greens. And, there is a collection device including a centrifugal pump and a channeling device for separating and collecting golf balls that have fallen into the pond water, and there is a detection indicator mechanisms indicating onto which green a golf ball falls.

Williams Sr., U.S. Pat. No. 5,219,161 discloses an apparatus adapted for use as a green on a golf driving range wherein golf balls which land on the apparatus are prevented from remaining thereon. The apparatus includes a golf green surface having a perimeter in the shape of a golf green and an interiorly located cup opening. The apparatus includes self clearing means so that golf balls inherently roll off of the green, or by providing a mechanism which raises and lowers one end of the green surface in order to clear balls therefrom. The self clearing green is well suited for use on golf driving ranges to clear the clutter of golf balls.

Meikle, U.S. Pat. No. 5,580,320 discloses an artificial golf green designed for use at driving ranges. The target green structure is formed at an incline to give users of the golf range the appearance of a larger target due to the perspective effects when viewing an inclined object from a distance. The construction of the target green is sectional to facilitate transportation. The ball landing surface includes artificial turf and an energy absorbing pad for realistic performance.

W. B. Crump, U.S. Pat. No. 3,520,727 discloses forwardly divergent arms, held rigidly so as to form a throat of a conveyer frame, and to swamp the balls on the ground toward an inclined table. A belt conveyor superimposed on the inclined table engages the balls and rolls them up the table so that the balls drop into a container, in which container there are ball carrying cages immersed in water. The golf balls are washed during the collecting operation by the forward and rocking motion of the container. The unit is pulled by any suitable means such as by a motorized vehicle coupled to a crossbar connecting the divergent arms at their widest spaced ends.

Heffley, Jr., U.S. Pat. No. 4,945,923 discloses a game apparatus comprised of a plurality of target zones each of which is operatively connected to an impact responsive signal generator. There is a signal selecting circuit and a scoreboard by which objects impacting upon the target produce signals above an adjustable level that will register on the scoreboard. In a specific embodiment, the target may take the form of a simulated golf green and is combined with an all-weather golf driving range including a driving booth in which the environment is controlled, a fairway designed such that snow removal and ball retrieval are enhanced, and a device for registering the longer drives.

The prior art teaches the use of a movable simulated ground supported golf green and also teaches the use of ground supported golf ball pickup vehicles. However, the prior art does not teach a motorized water supported golf green ball retriever and return to tee combination. The present invention teaches such a ground or water supported combination apparatus and its related advantages.

It is an object of this invention to retrieve golf balls from the driving range in and around designated green areas and automatically return them to the tee area. There are two typical practice range applications disclosed herein, 1) the conventional ground field range where mechanical ball retrievers are operable, and 2) a unique water pond trap range wherein aquatic retrieval is required. In both of these two types of practice ranges there is a mobile green for the golfer's short, medium and long range target practice driving of the golf balls. Positioning of the mobile green is made according to the capability of participating golfers.

The ground field practice range state of the art provides golf ball retrieval apparatus, however the more challenging water pond trap at golf courses of the prior art have been lacking in mechanical golf ball retrieval apparatus. This is a water barrier type trap found at many golf courses, to be encountered and conquered by the golfer. Therefore and in accordance with this invention it is an object to provide the aquatic combination of movable-positionable golf greens with ball retrieval and ball return to the tee facility of the range, as shown in the drawings and hereinafter described.

An object of the present invention is to provide a remote controlled mechanized golf green and golf ball pickup and return to the tee apparatus in combination having advantage is not taught in the prior art.

Another object of this invention is to provide an appartus as thus far described which is aquatic and such as to be floated in a water pond trap and movable infinitely therein, and mobile for the gathering of golf balls floating in said pond.

Still another object of this invention is to provide a golf ball drop and conveyer apparatus for the reception of collected golf balls and their automatic return to the tee area of the driving range for reuse.

And, still another object of this invention is to provide lifts to raise the collected golf balls from lower levels, as when floating in the water pond trap or when the tee area is at a higher elevation, and/or at the delivery end of a gravity operated conveyer to the tee, where the golf balls are deposited into a basket for reuse.

And a further object of this invention is to provide means for positionably rotating the green apparatus so as to be oriented to face its direction of travel or with respect to the direction in which golf balls are driven by the golfers from the driving range tee area.

SUMMARY OF THE INVENTION

The present invention teaches certain benefits in construction and use which give rise to the objectives set forth.

The present invention provides a movable simulated golf green of a size making it practical for practicing approach shots of a golf driving range, or other location. The apparatus is constructed as part of a positionable vehicle that is mobile so as to be moved about to various selected locations on the range. The green surface is made of a flexible sheet material laid over, but only connected to a structural under layer along its periphery. Thus, an air layer pumped therebetween causes the flexible layer to rise to a position slightly above the structural under layer. The inner facing surfaces of the sheet and under :layer have metallic contact surfaces so that when they contact each other an electrical circuit is closed.

The electical circuit has a power source and there are several lamps for illumination when a golf ball contacts the green surface and forces the metal layers into momentary contact. The circuit is compounded so as to indicate by different color lamps, where the golf ball impact on the green is from a flagpole positioned on the green. The flagpole is supported by the green in an upright position and the lamps are carried by the pole so as to be visible from the tee area of the driving range. Because a momentary lighting of a lamp may not be adequately visible, the circuit includes timed latching relays to selectively lengthen lamp illumination.

The mobile green apparatus in its ground field embodiment provides a ground supported ball pickup means which retrieves stray golf balls laying on the turf and temporarily deposites them into a bin carried by the apparatus for delivery at a drop location and subsequent transport via conveyer means to the driving range tee area The mobile green apparatus in its water supported embodiment provides a water immersed golf ball collecting means which retrieves stray golf balls floating in the pond water and temporarily holds them for delivery at a drop location and subsequent transport via conveyer means to the driving range tee area.

When the green apparatus is moved from one position to the next on the ground range or in the water pond, it picks up and/or collects stray golf balls laying or floating in its path as it travels about from one range position to another. The device is preferably remotely controlled by radio commands from a fixed location and incorporates an on-board controller that steers the apparatus to each new target position on the golf range; and guides it via a rout for picking and/or collecting stray golf balls laying or floating thereabout.

The foregoing and various other objects and features of this invention will be apparent and fully understood from the following detailed description of the typical preferred forms and applications thereof, throughout which description reference is made to the accompanying drawings.

THE DRAWINGS

Figure 9:
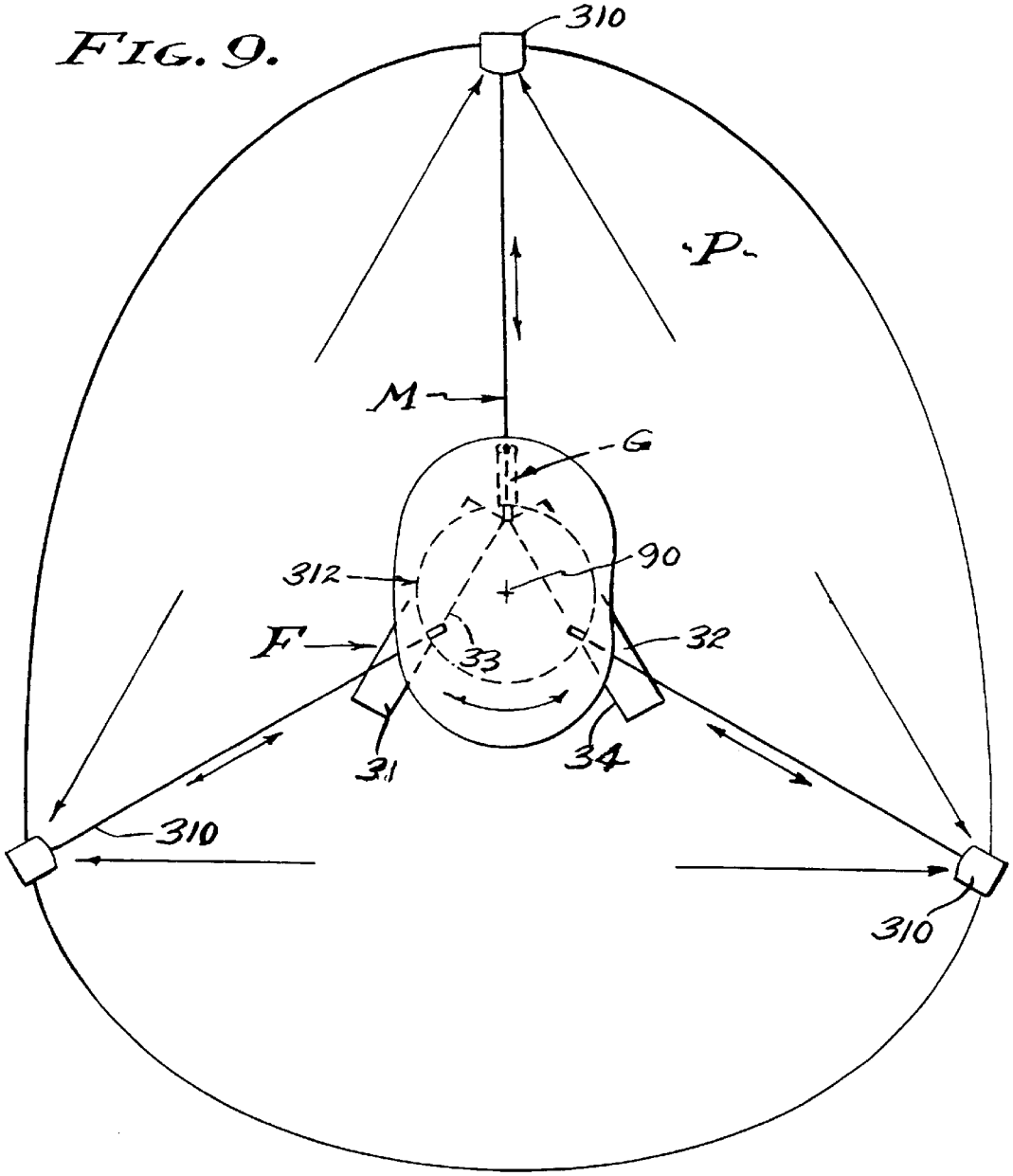

And FIG. 9 is a plot plan of the water supported aquatic embodiment, illustrating mobility means therefor.

PREFERRED EMBODIMENT

The above described drawing figures illustrate the invention, in the form of a moving golf practice green, ball pickup and return apparatus for use in a golf practice park such as a golf ball driving range or other such related setting.

The apparatus is comprised of an engine driven vehicle 1 having a propulsion means 3. This propulsion means 3 is preferably, but not limited to, a fuel powered engine or electric motor, and this apparatus is preferably built on any one of a variety of existing gasoline, pressurized gas, or an electric golf course type vehicle or motorized golf cart.

Figure 1:
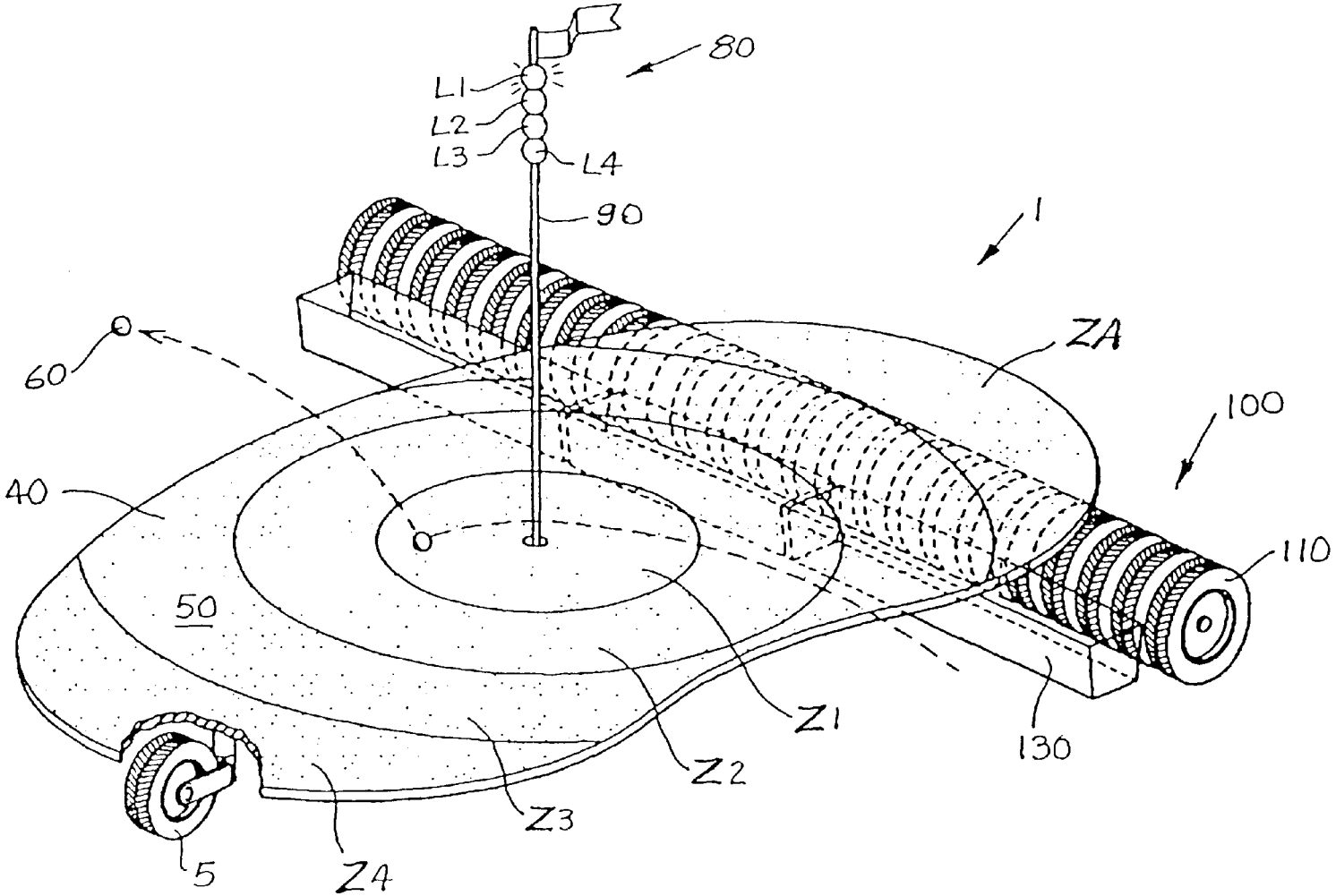
FIG. 1 is a perspective view of the ground field embodiment of the present invention.

The apparatus includes a steering means 5, preferably a simple chain drive, a rack and pinion drive, or other mechanical drive of common type well known in the art. The vehicle 1 is provided with four or three wheels as shown in FIG. 1. The steering means 5 enables the vehicle 1 to be directed to a desired driving range position, to be routed on a ball pickup course, and to be moved in tight quarters and for garaging, and as such the steering means 5 provides steering rotation of 90° to either side.

Movement of the apparatus is preferably controlled by a remote control means 10 through the use of any type of wave energy such as radio, sound or light energy. This is accomplished as by positioning a wave energy receiver 4 on-board the apparatus and a wave energy transmitter 2 at for example, a tee location within its transmitting range. Preferably, a computer system functionally operates the transmitter and provides course programming and directing of the apparatus.

The apparatus is moved by manual direction over a desired course using the fixed site transmitter, from one selected position to another and by way of a desired course between the selected positions. The set of selected positions and courses then make up a desired programmed itinerary which is set into a computer memory. The computer has the ability to store a number of such programs and the ability to select any one of them at any time. Such remote or programmed control with one of two-way wireless transmission are well known in the art and so are not detailed herein.

The apparatus provides, appropriate on-board servo-controls for automatic engine startup, drive engagement and velocity control and steering, so as to be able to follow program directions from the computer system. In a still further embodiment, the apparatus may carry, on board, the computer system for programming and directing the apparatus whereby wireless communication is not employed.

Figures 2A, 2B, 2C:
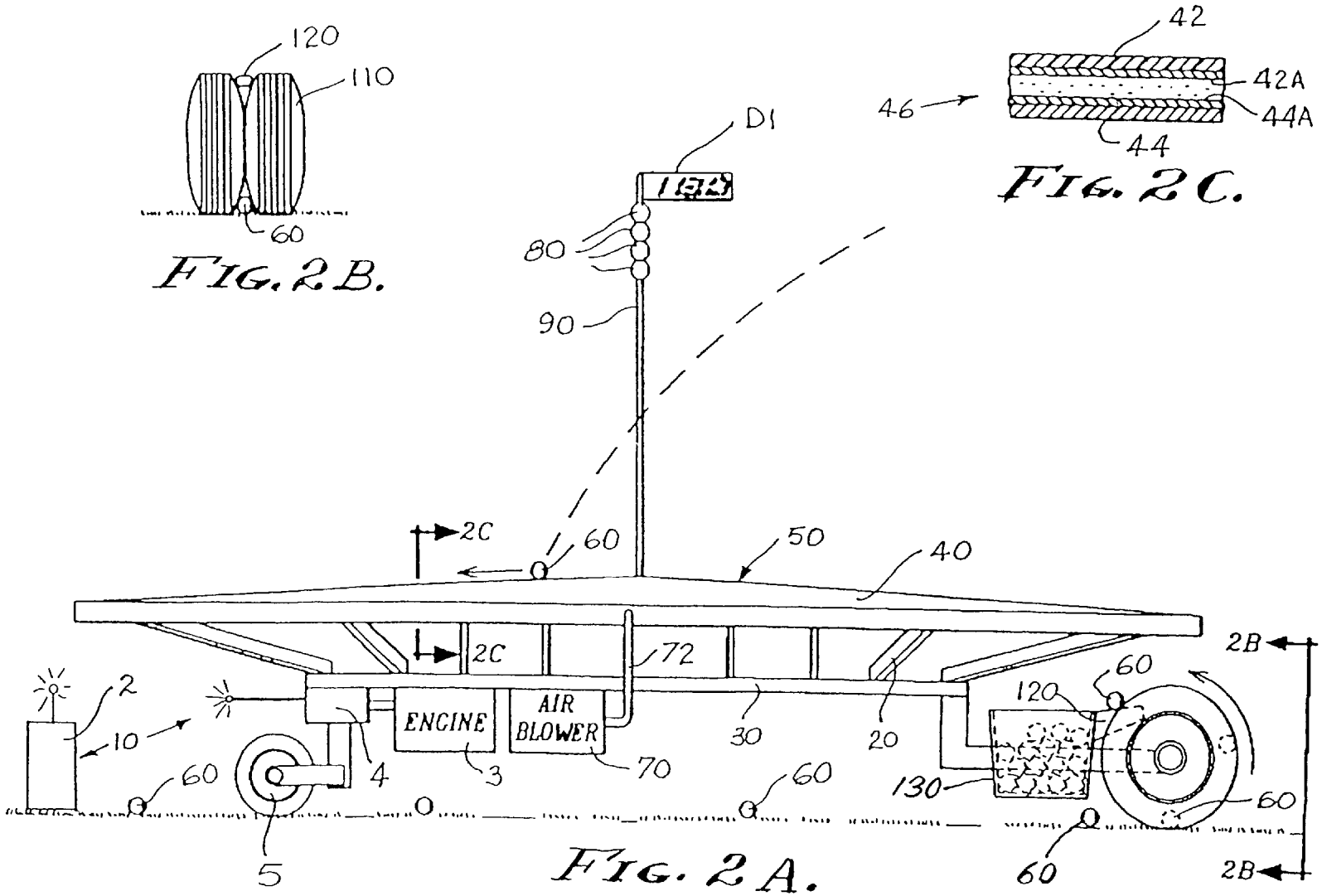
FIG. 2A is a side elevation thereof.
FIG. 2B is detailed view taken as indicated by line 2B—2B pm Fog. 2A.
FIG. 2C is a detailed view taken as indicated by line 2C—2C on FIG. 2A.
Figure 3:
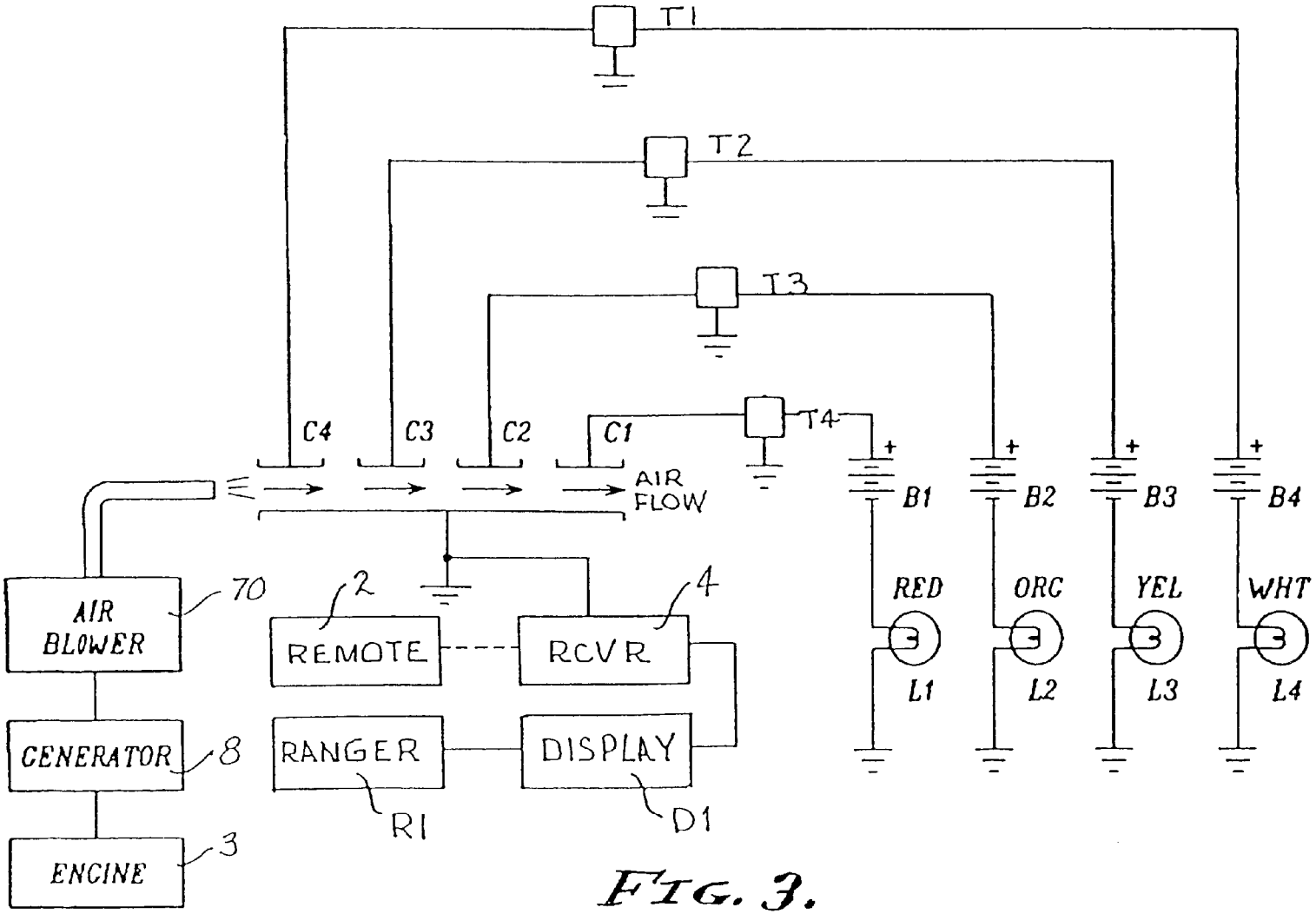
FIG. 3 is an electircal schematic of the control means.

The apparatus as shown in FIG. 2A employs a mat support structure 20 preferably comprised of a plurality of rigid struts of wood, metal, or plastic structural elements extending upwardly from a base plate 30. The mat support structure 20 supports a golf ball impact mat 40 over and held in place by the mat support structure 20 so as to present an upwardly facing ball contact surface 50 for visually simulating a golf green and for receiving golf balls 60 which are driven by golfers from tees (not shown) remote from the apparatus for golf drive practice. The golf ball impact mat 40 is comprised of a top layer 42 and a bottom layer 44 (FIG. 2C) that provide a golf ball impact sensing means 46. The top layer 42 is a flexible, light weight, sheet material such as a plastic or rubber sheet stock. It has bonded to it, or alternately impregnated into it, an electrically conductive surface layer 42A. The conductive surface layer 42A is a contiguous layer broken into several zones Z1, Z2, Z3 and Z4, such as shown in FIG. Each of the zones is in a separate electrical circuit as shown in FIG. 3 as C1, C2, C3 and C4 respectively. The bottom layer 44 is a more rigid sheet or plate and is held in place on the mat support structure 20. It too provides a conductive surface or coextensive overlayer 44A connected to an electrical ground or return path as shown in FIG. 3 . Such electrical surfaces are preferably electroplated, painted or otherwise placed onto the top and bottom layers in face-to-face adjacency. The top and bottom layers 42 and 44 are joined peripherally so that they are maintained in position, one over the other.

The apparatus further provides an air blower means 70 open into the impact mat 40 so as to force air between the top and bottom layers 42 and 44 of the impact mat 40, causing these layers to separate during operation of the apparatus. Therefore, the layers are not normally in electrical contact (FIG. 2C). The air blower means 70 is preferably an air pressurizing fan which induces air through a duct 72 opening between the top and bottom layers 42 and 44 of the impact mat. Thus, the mat 40 provides an impact sensing means 46 formed by the layers 42A and 44A relatively movable to open and close the circuits C1–C4, and forced into contact by a golf ball impact on the layer 42. The respective electrical contact layers close the circuits momentarily so as to illuminate a lamp means 80 as shown in FIGS. 1 and 2A. When the top and bottom layers 42 and 44 are separated by the air from the blower means, the top layer 42 assumes a slight incline away from the pin or flagpole 90 so that golf balls 60 landing on it tend to roll off the mat 40 as shown in FIG. 2A. Alternative means for maintaining the two layers apart, other than an air layer, will be obvious to those skilled in the art and such are incorporated in the present invention. Further, alternative means for detecting the impact of a golf ball on the impact mat will be obvious to those skilled in the art and such are incorporated in the present invention.

In the preferred embodiment of the invention, the impact sensing means 46 includes a plurality of separate impact sensing circuits C1–C4, positioned at the aforesaid zones Z1–Z4 surrounding the flagpole 90. Each of the impact sensing circuits is inter-connected with one of a plurality of lamps L1–L4 of the lamp means 80. One of the lamps of a selected distinctive color is illuminated by each golf ball impact on the impact sensing means 46 so as to indicate circular distances from the flagpole 90 where said impact occurred. In the preferred embodiment, a red lamp L1 is used to indicate an impact closest to the flagpole. A orange lamp L2 is used to represent the next closest region to the flagpole on the impact mat. And a yellow lamp L3 represents the next closest region followed by a white lamp L4. These lamps are preferably four separate lamps carried by the flagpole 90 with the red lamp L1 on top, or alternately there may be one lamp lens cover element with four separate bulbs within.

The lamp means 80 and electrical circuit of FIG. 3 also includes energy storage means B1–B4, such as storage batteries, and a latching timer means T1–T4 for each lamp circuit. Each electrical lamp circuit is interconnected with the golf ball impact sensing means 46 (C1–C4) such that the impact of a golf ball landing on the impact mat 40 enables the circuit means 46 to illuminate the lamp means L1 or L2 or L3 or L4 for a predetermined time period, preferably but not limited to, one second. Means for flashing the bulbs simultaneously is provided for illuminating the bulbs some seconds prior to the apparatus moving to its next location.

The energy storage means B1–B4 are recharged by an electrical generator 8 powered by the propulsion means 3. The electric circuit may further include a detecting means R1 for indicating the distance between the vehicle 1 and the remote control transmitter 2 which is preferably located at the tee site where the golf balls are hit, and may be any standard radio beacon range finder R1 well known in the art (see "Ranger" in FIG. 3,) and a display means D1 for displaying the distance as shown in FIGS. 2A and 3. As shown in FIG. 3, the distance of the vehicle 1 from the tee positions is continuously displayed by a Liquid Crystal Display (LCD) so that golfers will see the distance from the tee to the pin.

The apparatus in its ground field embodiment shown in FIGS. 1–3, includes a golf ball pickup and storage means 100, such as the SL90 Series, Model #71875 of Wittek, Inc., adapted for moving with the vehicle and positioned for picking up golf balls 60 laying on the ground surface of the golf practice park. The golf ball pickup and storage means 100 includes, a plurality of adjacent wheels 110 having rolling support with the ground surface of the golf practice park. These wheels 110 help support the apparatus. The wheels are spaced apart for wedging ground supported stray golf balls therebetween as the wheels move over them resting upon the groung surface (FIG. 2B). A picking means 120 extends between each pair of the wheels 110 for extracting the golf balls wedged therebetween for delivery into a golf ball storage means 130, typically an elongate bin as best illustrated in FIG. 1. The picking means 120 is a series of arms that extend out from the storage means 130 . The golf ball pickup and storage means 100 is adapted to the apparatus by fixing it to the mat support structure 20 and baseplate 30 for supporting and moving with the vehicle and it is positioned for receiving golf balls that land on, and then fall to the ground around the apparatus.

Figure 4:
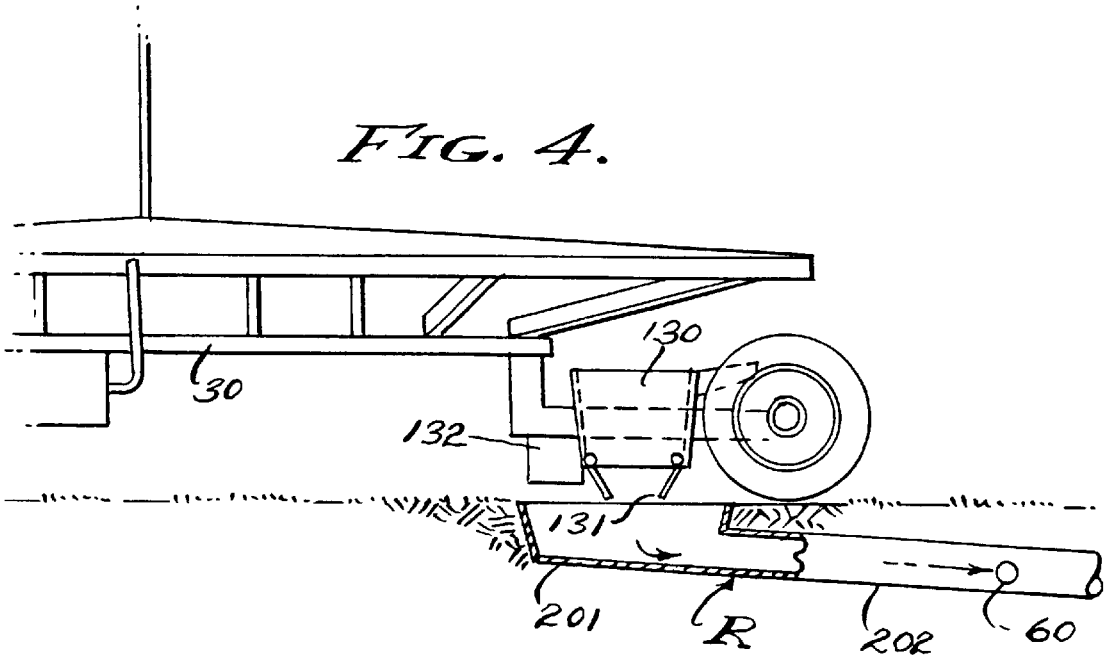
FIG. 4 illustrates a portion of FIG. 2A and illustrates the ground field embodiment golf ball return means.
Figures 5, 7:
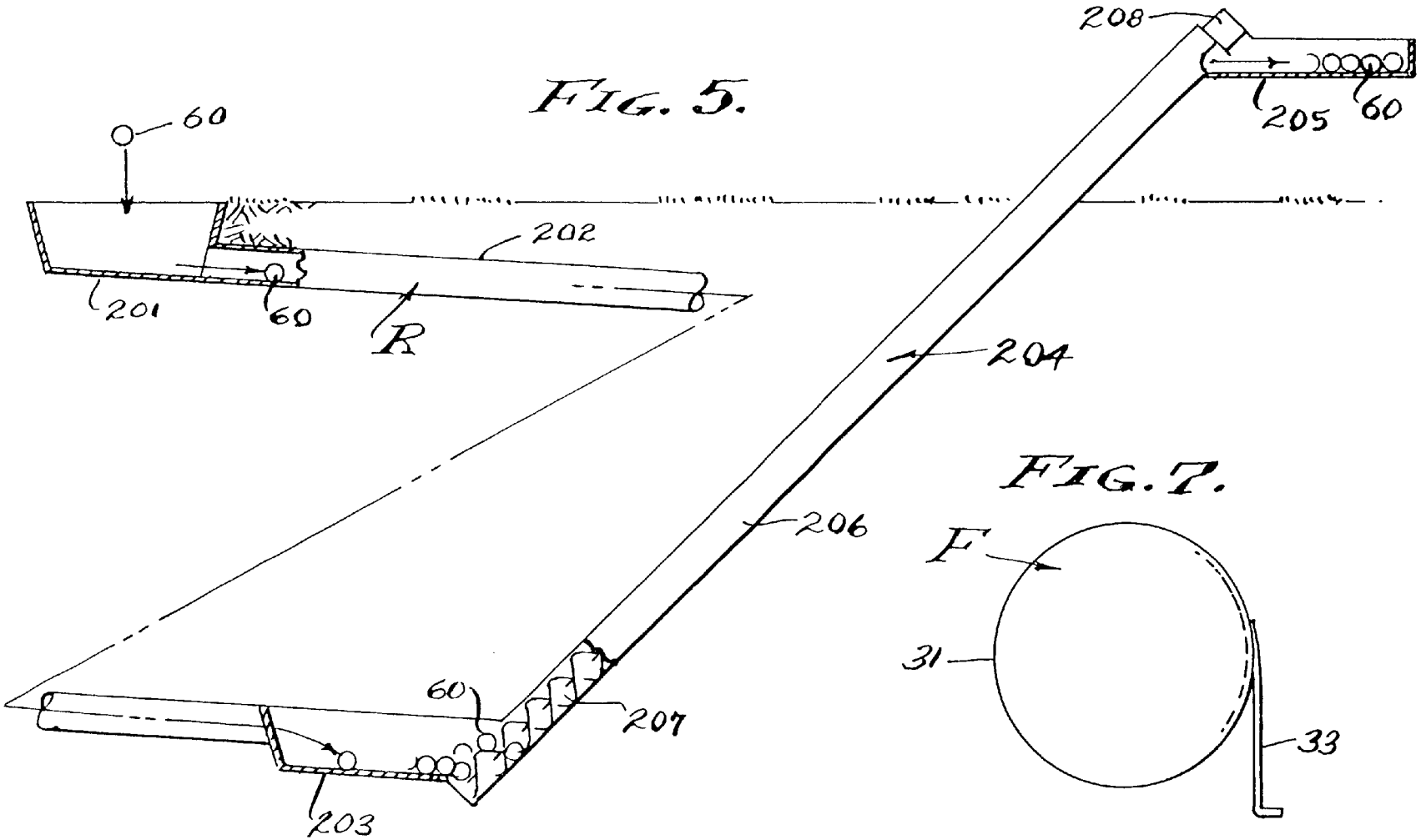
FIG. 5 is an exploded sectional view illustrating the basic golf ball return ground installation as employed for either the ground field embodiment or the water supported or aquatic embodiment.
FIG. 7 is an enlarged detailed sectional view taken as indicated by line 7—7 on FIG. 6.

Referring now to FIGS. 4 and 5 of the drawings, the ball pickup and return apparatus includes a stationary golf ball receiver and return means R for receiving balls 60 from the golf ball storage means 130, and/or from the ball pickup means G of the aquatic embodiment later described.

As shown in FIG. 4, the remote or programmed steering means is instructed to postition the elongated bin of the ball storage means 130 in position over a designated placement on the golf practice park turf where a ball reception box 201 is installed at ground level, not to preclude other levels. As is shown, the bin of means 130 has normally closed bottom doors 131 that are automatically opened as by actuator means 132 motorized to be programmed by the aforesaid computer means to open said doors and drop the balls from said storage bin aligned with said ball reception box 201 of the return means R.

In accordance with this invention, the ball return means R is comprised of a ball conveyor tube 202, preferably a subterranean tube buried as it extends from the designated position of reception box 201 to a remote receiver box 203 beneath the area of the tee T. The distance between the boxes 201 and 203 is substantial, for example 100 yards or more, and movement of the golf balls from the reception box 201 to the receiver box 203 is preferably by the means of gravity, the ball conveyor tube being declined one fourth inch per running foot, more or less as may be required. At the tee area a ball elevator means 204 is provided, preferably an inclined Archimedes screw device in the form of a motor driven auger-tube that lifts the balls arriving at the receiver box 203 and delivers them to a retrieved golf ball supply tray 205 conveniently positioned above the turf level at the tee area. As shown, the ball elevator means 204 is comprised of an inclined tube 206 within which a ball lifting auger 207 is rotated by a motor 208. Such auger type elevators and lifts are well known in the art for lifting and horizontally conveying a variety of materials.

Referring now to FIGS. 6–9 of the drawings, the apparatus in its aquatic water supported embodiment has all of the basic features hereinabove described with respect to the ground field supported embodiment of FIGS. 1–5, except for the means of support, mobility and ball pickup collection. Accordingly, the aquatic apparatus is comprised of unique maneuvering means M for mobility, substituting for the steering means 5. However, the remote control means 10 and associated computer system is operative to control this aquatic embodiment. Also, the wheeled support is substituted for by flotation means F for water support in a water pond trapP. And, the ball pickup and storage means 100 is substituted for by gathering and collecting ball pickup means G for concentrating stray golf balls into a lift means 304 and for dropping said balls into the ball reception box 201 of the above described return means R when the means 304 and box 201 are aligned (see FIG. 8).

Figure 6:
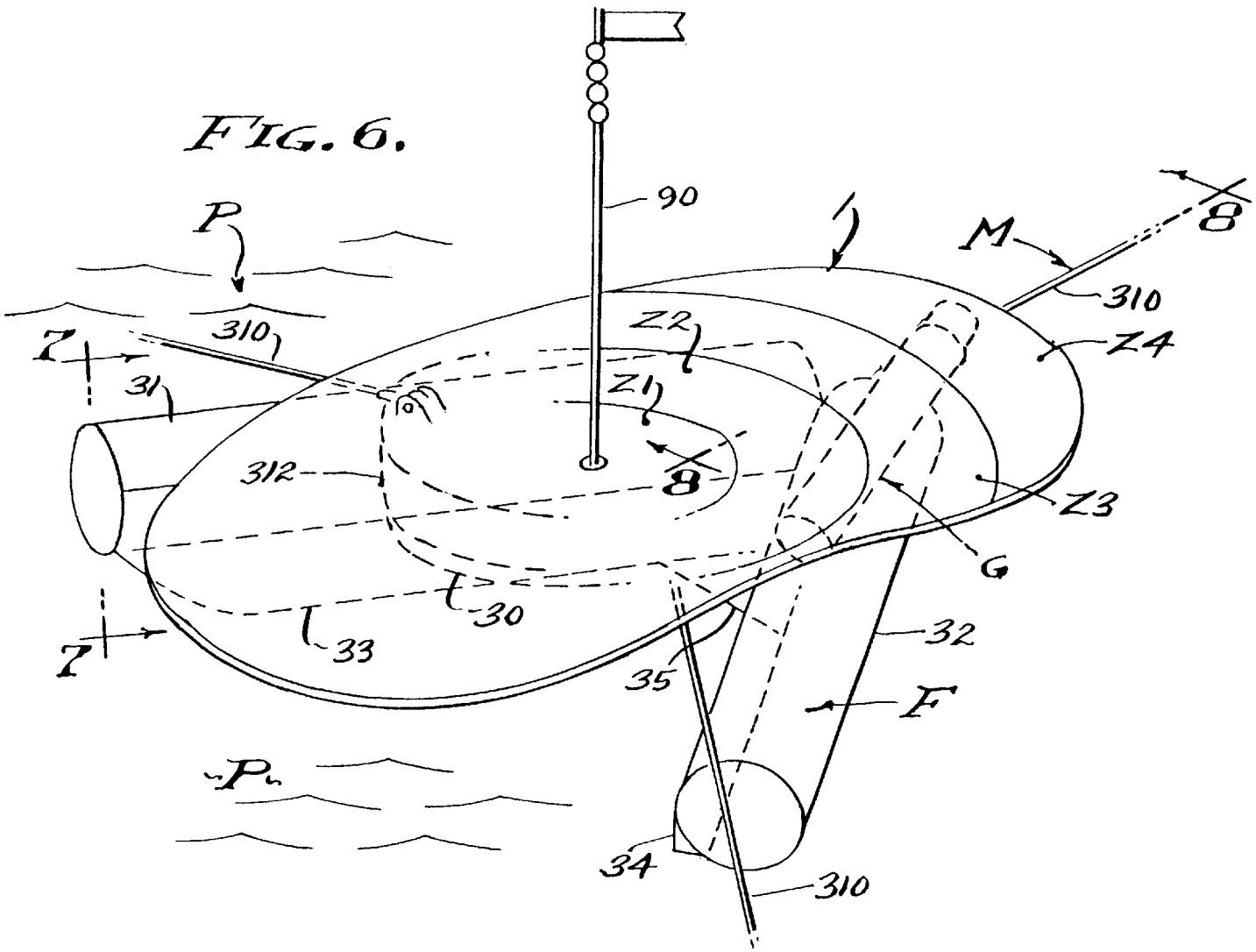
FIG. 6 is a perspective view similar to FIG. 1, of the water supported embodiment of the present invention.

Referring now to FIG. 6 of the drawings, the flotation means F for water support of the apparatus is comprised of a pair of laterally spaced pontoons or floats 31 and 32 carrying the base plate 30 of the entire apparatus (see FIG. 2A). The floats are horizontally disposed and are convergent from a forward end of the appartus as they extend to the rear thereof. The purpose of this convergence is unique with respect to the gathering and collecting means G next described. In practice, the combined centers of buoyancy of the convergent floats 31 and 32 is located at the center of gravity of the apparatus for horizontal stability.

The stray golf ball gathering and collecting ball pickup means G is unique with the present invention, and is dependent upon golf balls that will float in fresh pond water P. Accordingly, state of the art golf balls are employed herein and which are very slightly buoyant. In practice, these buoyant golf balls are very slow to rise when depressed into the water. However, their buoyancy ensures that they will rise slowly to the surface, or to float slightly below the water surface.

In accordance with this invention, the inside faces of the floats 31 and 32 are provided with smooth vertical guide walls 33 and 34 to engage and concentrate the floating balls when the apparatus is moved forwardly through the pond waters P from position to position or when on computer programmed ball retrieving excursions. In practice, the mass of said balls inherently causes them to concentrate and/or bunch inwardly toward the apex of the walls 33 and 34. However, and in accordance with this invention, said apex remains separated so as to accommodate the lower ball reception end portion of the lift means 304, there being a horizontal shelf 35 at the lowermost extremity of the lift means so as to limit sinking of the balls below the ball reception opening of said lift means.

Figure 8:
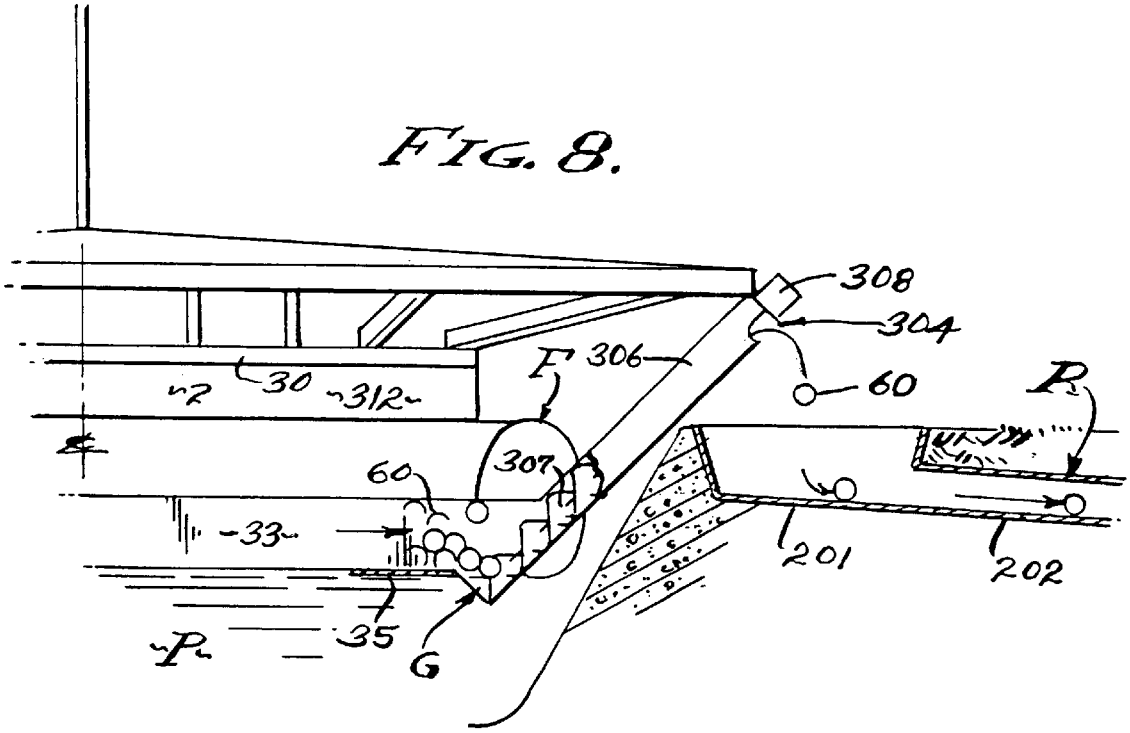
FIG. 8 is a view similar to FIG. 4 and illustrates of portion of the aquatic embodient.

The ball lift means 304 is preferably an inclined Archimedes screw device in the form of a motor driven auger-tube that lifts the balls collected at the shelf 35 and delivers them to the ball reception box 201 of the ball return means R hereinabove decribed. As shown, the ball lift means 304 is comprised of an inclined tube 306 within which a ball elevating auger 307 is rotated by a motor 308. As shown in FIG. 8, the auger 307 deposites the retrieved golf balls 60 into the reception box 201 of the ball return means R for subsequent delivery thereby to the supply tray 205 at the golfer's tee T.

Referring again to FIGS. 6–9 of the drawings, the maneuvering means M is shown to provide mobility to the golf practice green apparatus by which it is moved from one precise location or placement to another directed as by means of a Global Positioning System (GPS) or the like, and by which it is motivated along prescribed courses for ball gathering and pickup by the means G. The maneuvering means M is comprised of a plurality of cable-winch means 310, and preferably a minimum of three such means extending radially from the pin or flagpole 90 of the green and angularly spaced equilaterally at an angle 120°. Other radial spacing can be employed dependant upon the plan configuration of the water pond P. In this embodiment, the base plate 30 is a turntable centered on the axis of the green and positionably rotated on said axis by directive orientation means 312 responsive to programmed computer control. As shown in FIG. 9, the pin axis of the green is central within the equilateral placement of the cable-winch means 310 at the perimeter of the water pond. Movement and/or repositioning of the green apparatus is by shortening and lengthening complementary cables of the means 310, whereby the green apparatus is moved along or positioned between an opposed pair of winches of the means 310 and displaced from an alignment between said pair of winches by a third winch means 310 (see FIG. 9). Accordingly, the green apparatus is omni mobile within the equilateral placement of the cable-winch means 310.

The directive orientation means 312 is coordinated with the cable-winch means 310 for facing the front of the green ball pickup means G in the direction of movement, so as to gather stray golf balls when progressing about the water pond. For example, the means 312 is comprised of a direction sensor means responsive to the rotational disposition of the golf practice green for rotatably positioning the turntable base plate 30 to face the pickup means into the direction of movement. The means 312 is also programmed to rotatably orient the green apparatus with respect to the golfing tee T as-may be required.

In operation, the moving golf practice and golf ball pickup and return apparatus is moved directly or by circuitous routes to various positions around the driving range or water pond trap P, for practice driving and for stay ball pickup. As shown and hereinabove described, the apparatus is programmed to follow ball gathering courses and to stop at predetermined and designated points. Preferably, the apparatus is programmed to stop at each predetermined point for a length of time before moving on to a next point, or to creep along without stopping, and all of which is arbitrary as may be required. And at prescribed time intervals, the apparatus is motivated and moved continuously for gathering and picking golf balls off the ground or from the pond water. The apparatus is remotely controlled, or internally controlled, manually driven or pre-progammed, for golf driving range practice and for ball gathering pickup and return for reuse.

This invention provides a practice green and ball return apparatus that is fully automated, with a subterranean return conveyor that delivers used golf ball to the driving range tee, without shut-down of the golf practice range.

Having described only the preferred forms and applications of my invention, I do not wish to be limited or restricted to the specific details herein set forth, but wish to reserve to myself any modifications or variations that may appear to those skilled in the art as set forth within the limits of the following claims.

I claim:

1. A moving golf practice green, golf ball pickup and ball return apparatus for use in a golf practice park, the apparatus including;

a vehicle having a propulsion means, a steering means and a mat support structure, the vehicle being movable across a surface of the golf practice park, a golf ball impact mat positioned over the mat structure, and held in place by the mat support structure so as to present an upwardly facing ball contact surface of the impact mat for visually simulating a golf green, the impact mat providing a golf ball impact sensing means, a golf ball pickup means adapted for picking up golf balls on the surface of the golf practice park as the vehicle moves over the golf balls, a golf ball storage means adapted for moving with the vehicle and positioned for receiving the golf balls from the golf ball pickup means, an electrical circuit including energy storage means and lamp means, the electrical circuit being interconnected with the golf ball impact sensing means such that the impact of a golf ball landing on the impact mat enables the electrical cicuit for momentarily illuminating the lamp means, a stationary golf ball return means open at a designated position on the golf practice park for the reception of golf balls from said ball storage means of the apparatus and for conveying them to a ball supply for reuse by practicing golfers, whereby the apparatus may be moved to a position for practicing green approach golf shots, may be routed and moved continuously for picking up and collecting golf balls from the golf practice park surface, and may be stopped at said designated position on the golf practice park for dropping collected golf balls into said return means.

2. The apparatus of claim 1, wherein the golf ball return means is comprised of a ball reception box at a level of the golf practice park for receiving balls from said ball storage means of the apparatus, and conveyor means from the ball reception box to said ball supply for reuse at a golfer's tee.

3. The apparatus of claim 1, wherein the golf ball return means is comprised of a ball reception box at ground level for receiving balls from said storage means of the apparatus, and conveyor means including a ball elevator means for lifting the balls from the ball reception box to above ground level and to said ball supply for reuse at a golfer's tee.

4. The apparatus of claim 1, wherein the golf ball return means is comprised of a ball reception box at a level of the golf practice park for receiving balls from said ball storage means of the apparatus, and conveyor means including a ball conveyor tube for delivering balls to a receiver box and a ball elevator means for lifting the balls from the receiver box to above ground level and to said ball supply for reuse at a golfer's tee.

5. The apparatus of claim 1, wherein the golf ball return means is comprised of a ball reception box at a level of the golf practice park for receiving balls from said ball storage means of the apparatus, and conveyor means including a ball conveyor tube for delivering balls to a receiver box and a ball elevator means for lifting the balls from the receiver box to a ball supply tray above said level for reuse at a golfer's tee.

6. The apparatus of claim 1, wherein, the golf ball return means is comprised of a ball reception box at a level of the golf practice park for receiving balls from said ball storage means of the apparatus, and conveyor means including a declined ball conveyor tube for delivering balls by gravity to a receiver box and a ball elevator means having a motor driven screw for lifting the balls from the receiver box to a ball supply tray above said level for reuse at a golfer's tee.

7. A moving golf practice green, golf ball pickup and ball return apparatus for use in a golf practice park, the apparatus including;

a vehicle having a maneuvering means, and a mat support structure, the vehicle being movable across a golf practice park surface, a golf ball impact mat positioned over the mat structure, and held in place by the mat support structure so as to present an upwardly facing ball contact surface of the impact mat for visually simulating a golf green, the impact mat providing a golf ball impact sensing means, a golf ball gathering and collecting pickup means for retrieving golf balls at said golf practice park surface as the vehicle moves over the golf balls, an electrical circuit including energy storage means and lamp means, the electrical circuit being interconnected with the golf ball impact sensing means such that the impact of a golf ball landing on the impact mat enables the electrical circuit for momentarily illuminating the lamp means, whereby the apparatus may be moved to a position for practicing green approach golf shots, and may be routed and moved continuously for gathering and collecting and picking up stray golf balls at the golf practice park surface.

8. The apparatus of claim 7, wherein the electrical circuit further includes a latching timer means functional for enabling illumination of the lamp means for a predetermined time after each golf ball impact on the impact mat.

9. The apparatus of claim 7, wherein the impact sensing means includes a plurality of separate impact sensing circuits each positioned at a selected distance from a flagpole of the golf ball impact mat, each of the impact sensing circuits being interconnected with one of a plurality of lamps of the lamp means such that one of the lamps is illuminated by each of the golf ball impacts on the impact sensing means so as to indicate a distance from the flagpole said impact occurred.

10. The apparatus of claim 7, wherein the golf ball impact mat comprises a top layer and a bottom layer, the apparatus further providing an air blower means joined to the impact mat so as to force air between the top and bottom layers of the impact mat so as to force said layers apart, the mat further providing an electrical contact means formed on the layers and movable therewith such that with the layers forced apart the electrical contact means on the layers opens the circuit, and with the layers forced into contact by a golf ball impact on the top layer, the electrical contact means closes the circuit so as to illuminate the lamp means.

11. The apparatus of claim 7, further including a remote control means for enabling the apparatus to self maneuver within the golf practice park over a series of pre-selected positions and to delay between each of the pre-selected positions.

12. The apparatus of claim 11, further including a means for detecting the distance between the vehicle and the remote control means, and means for displaying said distance.

13. A golf ball pickup and ball return apparatus for use in a golf practice park where golf balls are driven from a tee area onto a surface of the golf practice park, including a remote control unit, a vehicle that is maneuverable over the surface of the golf practice park under the control of the remote control unit, said vehicle having connected thereto a golf ball retriever that collects golfs balls on said surface of the golf practice park, holds said collected balls until the vehicle is at a predetermined drop location at surface of the golf practice park, and delivers said collected balls to said drop location when the vehicle is at said drop location, a conveyor that forwards golf balls delivered to said drop location to the tee area, and an on-board mat simulating a golf green.

14. The golf ball pickup and ball return apparatus according to claim 13 where there is an on-board sensor that detects when a ball impacts the mat and provides a signal on such impact.

15. A golf ball pickup and ball return apparatus for use in a golf practice park where golf balls are driven from a tee area onto a surface of the golf practice park, including a vehicle that is maneuverable over the surface of the golf practice park under the control of a computer control system that is programnmed to direct the vehicle to move along a desired course over said surface of the golf practice park according to a predetermined itinerary, said vehicle having connected thereto a golf ball retriever that collects golfs balls on said surface of the golf practice park, holds said collected balls until the vehicle is at a predetermined drop location at surface of the golf practice park along said course, and delivers said collected balls to said drop location when the vehicle is at said drop location, a conveyor that forwards golf balls delivered to said drop location to the tee area, and an on-board mat simulating a golf green.

16. The golf ball pickup and ball return apparatus according to claim 15 where the conveyor includes an inclined subterranean tube extending from the drop location to the tee area.

* * * * *